US005319332A

United States Patent [19]

Espinosa

[11] Patent Number: 5,319,332

[45] Date of Patent: Jun. 7, 1994

[54] MAGNETIC SHIELD FOR VIDEO MONITOR YOKES

[75] Inventor: Israel Espinosa, La Porte, Ind.

[73] Assignee: Computron Display Systems, a division of Xcel Corporation, Elk Grove Village, Ill.

[21] Appl. No.: 791,578

[22] Filed: Nov. 12, 1991

[51] Int. Cl.[5] ..... H01H 1/00; H01H 5/00; H01F 1/00

[52] U.S. Cl. ..... 335/214; 335/212

[58] Field of Search ..... 335/214, 212; 315/8, 315/85

[56] References Cited

U.S. PATENT DOCUMENTS 2,431,077 11/1947 Poch ..... 335/212
2,795,717 6/1957 Finkelstein et al. ..... 335/212
3,618,125 11/1971 Yabase ..... 335/212
5,194,776 3/1993 Chevalier ..... 335/214

*Primary Examiner*—Harold Broome
*Attorney, Agent, or Firm*—Louis Bernat

[57] ABSTRACT

A yoke for a cathode ray tube has deflection coils and a plurality of trim magnets mounted thereon. A tubular shield of Mu-metal slides over the coil to suppress an electromagnetic field radiated therefrom. In one embodiment, the trim magnets are inside the shield so that it has to be removed in order to adjust the magnets. In another embodiment, the trim magnets are outside the shield, so that they may be adjusted without necessarily having to remove the shield. The shield greatly reduces outwardly directed electromagnetic radiation in the vicinity of the cathode ray tube which allegedly might produce a health hazard to an operator at a video monitor terminal.

16 Claims, 2 Drawing Sheets

MAGNETIC SHIELD FOR VIDEO MONITOR YOKES

This invention relates to means for and methods of shielding and greatly reducing electromagnetic radiation from cathode ray tubes, at lower cost, and with greater adjustment and maintenance convenience and, more particularly, to magnetic shields for yokes used on cathode ray tubes.

Reference is made to U.S. Pat. No. 4,943,753, granted Jul. 24, 1990, which shows a magnetic shunt for deflection yokes.

Cathode ray tubes have an electron beam which strikes fluorescent material on the rear side of the face plate of the tube in order to display an image thereon. The beam is deflected to trace an image or to follow a vertical raster of horizontal lines covering the face of the tube. Also, the beam must be focused into a spot of light on the face of the tube. Such deflecting and focusing are under the control of a yoke, including deflecting coils mounted on the neck of the cathode ray tube. These coils are energized by electrical currents which act through the glass envelope to deflect and focus the electron beam.

Recently, there has been much public concern for the alleged health hazard resulting from electromagnetic radiation from a cathode ray tube which might adversely affect the health of a terminal operator. Whether there actually is or is not such a health hazard is totally irrelevant. Laws, rules and regulations are springing up to limit such radiation. Many customers will not buy equipment unless the radiation is reduced. Therefore, as a practical and economic matter, it is imperative that shielding be added to reduce the radiation.

A deflection yoke not only produces, but also is susceptible to magnetic fields. Hence, one method of controlling radiation is to place a suitable metal shroud or shield over the deflection yoke, which is the main source of the radiation fields.

A shielding of the deflection yoke in this manner is a rather common practice, but the conventional shielding is provided for a different reason. More particularly, the yoke action of both creating and reacting to magnetic fields creates a common problem which is known in the video display industry as "swim". This "swim" describes a condition caused by beat frequencies occurring as a result of two non-synchronous but closely coupled fields. An example of coupled fields is found in a monitor scanning at a vertical frequency other than 60 Hz in proximity to an electrical appliance operating at 60 Hz. Another example of "swim" is where two side-by-side monitors operate at different scan rates. The way to prevent these magnetic coupling problems is to place magnetically permeable materials between the active items, i.e., the deflection yoke or yokes, as the case may be.

The structure of this inventive yoke leads to a rather unique and low-cost shield. While the main purpose of the invention is to reduce the electromagnetic radiation, it also has an especially valuable use on a yoke to prevent the "swim" problems.

For various and well-known reasons which are not important here, it is also necessary or desirable to provide permanent magnets in the vicinity of the deflection coils. The geometric positions of these magnets are adjusted to "trim" the picture. The adjustment requires physical access for the tools and hands of the person who is building, servicing or adjusting the cathode ray tube. Usually, the space within a monitor cabinet containing the tube is severely limited. Often, some electronic equipment, wires, or the like, are positioned between the person and the magnets which he is trying to adjust. This equipment blocks the person's view and work space and makes it extremely awkward for him to use his hands, tools, or the like.

If the radiation shielding is in place, within an already limited space and sometimes inaccessible area, as within a video monitor cabinet, it tends to make the adjustment of the permanent magnets extremely difficult. For example, in a factory which builds video monitors, it is not uncommon for "geometry" operators to spend up to about four hours simply adjusting the positions of permanent magnets on the yoke. Considering the nature of the various manufacturing jobs and the relative value added by each of the factory workers that are required to make a video monitor, the geometry operator represents one of the most expensive jobs in the factory.

Accordingly, there is a need for new and improved means for and methods of adjusting magnets on the yoke of a cathode ray tube while shielding it from radiating electromagnetic waves from the deflection coils. Another object of the invention is to provide yokes having magnets which can be adjusted while the magnetic shield is in place.

Yet another object is to reduce the cost of video monitor production without sacrifice of quality.

In keeping with an aspect of the invention, these and other objects of the invention are accomplished by a use of an electromagnetic shielding, especially one which can be placed in a position which does not interfere with the adjustment of the trim magnets.

While it is not limited thereto, the invention preferably uses a yoke which is manufactured by the Totoku Company of Tokyo This company manufactures a number of different yokes which may be selected to suit the needs of a particular cathode ray tube and video monitor. In video monitors which were actually built and tested, a Totoku Type TMD-2800 Yoke was used. One of the inventive shields which was used in connection with these yokes is to be designated Shield Type No. 11-175-01C by Computron Display Systems, assignee of this invention.

Preferred embodiments of the invention will be understood from a description and study of the attached drawings, in which.

Figure 1:
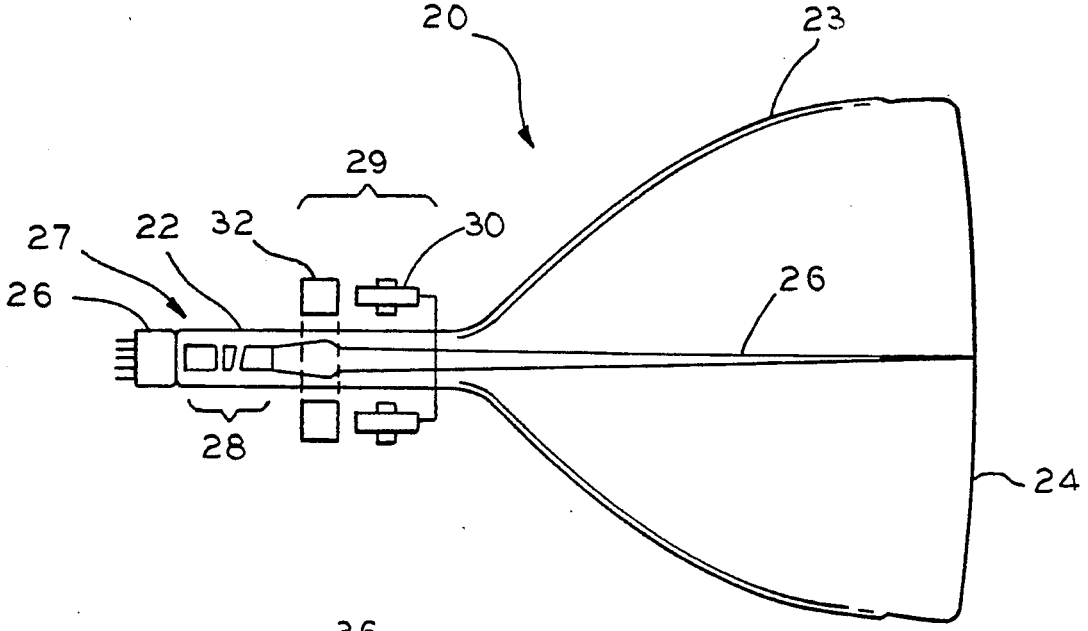
FIG. 1 (PRIOR ART)
FIG. 1 is an outline of a generic cathode ray tube with a stylized yoke mounted on the neck thereof.

A conventional cathode ray tube 20 is seen in FIG. 1 as having a neck 22 and a bell or funnel 23. A face 24 of the tube is positioned at the end of bell 23 and is covered on the inside by a fluorescent material which is activated by an electron beam 26 to give off a spot ("beam spot") of light defined by the cross-sectional area of the electron beam 26 as it strikes the face 24. The electrons in the beam 26 are given off from a hot cathode at the end 27 of the neck 22. Electrodes 28 accelerate the electrons in the beam and shape the beam to bombard a point on the face 24 of the tube. In order to deflect the beam to trace an image or to create a vertical raster of horizontal lines, a yoke 29 including a deflection coil 30 and focusing device 32 is slipped over the end of the neck 22 and up to or almost against the bell 23 of the tube 20. By adjusting the position of the yoke with its deflection coil 30 and a focusing device 32, a proper beam spot, image or raster may be produced.

The deflection coil 30 produces the radiated electromagnetic field which is the reason for health concern. Therefore, the problem is to contain that field and not to let it escape from the TV or monitor cabinet, without adversely affecting the functions of the coil.

Figure 2:
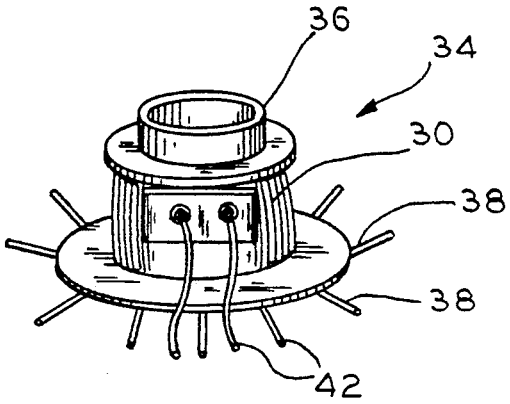
FIG. 2 (PRIOR ART)
FIG. 2 is a perspective view of a first style of yoke which may be used on and in connection with a cathode ray tube.
Figure 3:
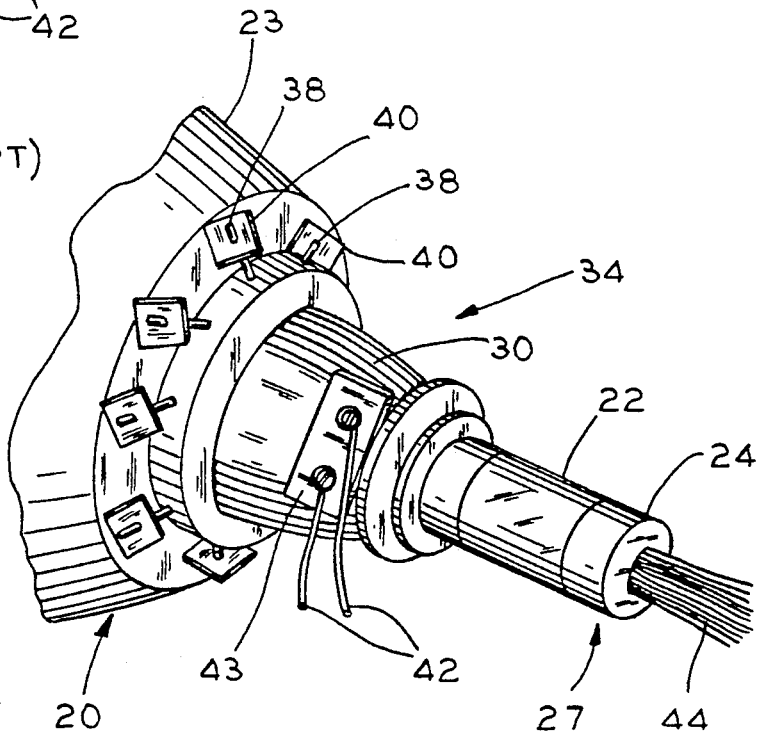
FIG. 3 is a perspective view of a part of the cathode ray tube with the yoke of FIG. 2 and with trim magnets in place and exposed to be adjusted.

An example of a yoke 34 is seen in FIGS. 2, 3 as including the deflection coil 30 on a suitable former (preferably made of molded plastic) having a number (here eight) of posts or spokes 38 radiating therefrom. Leads 42 are attached to a mounting board 43 and, in turn, to coil 30. Geometry trim magnets 40 are in the form of square plates having a transverse mounting means, here a hole in the center of the square, for engaging an individually associated one of the posts. These magnets may be turned or positioned on the posts 38 to geometrically adjust the image on the face of the tube.

In FIG. 3, the yoke 34 of FIG. 2 has been slipped over end 27 and onto neck 22 of the cathode ray tube 20. Geometry magnets 40 have been mounted on the tops of posts of spokes 38. The geometry operator must now adjust the positions of these magnets until the desired effects appear in the picture displayed on the face plate 24 of the cathode ray tube. This is often done while the cathode ray tube is mounted inside of a cabinet. Thus, the space surrounding the cathode ray tube is severely limited so that the geometry operator has trouble seeing, touching, and adjusting the magnets.

Moreover, much of the equipment inside the cabinet is sometimes nearby to further inhibit the adjustment of these magnets. By way of example and to symbolize this and other such equipment, FIG. 3 shows wires 42 leading from the deflection coil 30 and wires 44 leading from the end 27 of the cathode ray tube 20.

Figure 4:
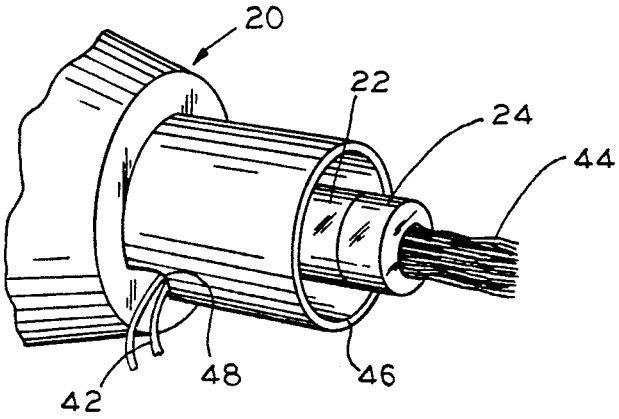
FIG. 4 is a perspective view of the cathode ray tube with the inventive shield in place over the yoke of FIG. 3.

FIG. 4 shows one example of a cathode ray tube 20 with the inventive shield 46 in place. The trim magnets 40 are completely covered by shield 46. A notch 48 in shield 46 gives access for the wires 42 to the deflection coil 30. This particular shield was 3.5" long and had a 3.512" outside diameter, although the dimensions for any given yoke shield is empirically determined and subject to change. It should be quite obvious that the final adjustment of trim magnets 44 is all but impossible once the shield 46 is in place.

Since the magnetic material of shield 46 is almost certain to have an effect upon the fields of the magnets 40, the final adjustment becomes one of installing and removing the shield, making small adjustments of the magnet positions while the shield is off the tube. Of course, the power must be turned off when the geometry operator has his hands in the high potential area which causes further practical problems. Hence, the embodiment of FIG. 4 reduces the radiation of the electromagnetic field, but it is somewhat awkward to use.

Figure 5:
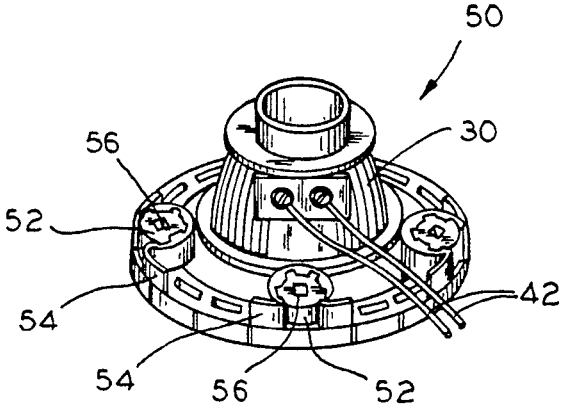
FIG. 5 (PRIOR ART)
FIG. 5 is a preferred magnetic yoke having magnets which will be outside of the inventive magnetic shield.

FIG. 5 shows another yoke 50 having a former (preferably plastic) with the deflection coil 30 mounted thereon. A number of cylindrical or barrel-shaped trim magnets 52 are mounted on an outwardly extending plate at an end of the yoke former. The magnets 52 are rotatably supported by means of a plurality of individually associated clips 54 which fit into a molded plastic base forming the outwardly extending plate. The important thing is that the magnets rotate axially relative to their poles.

Figure 6:
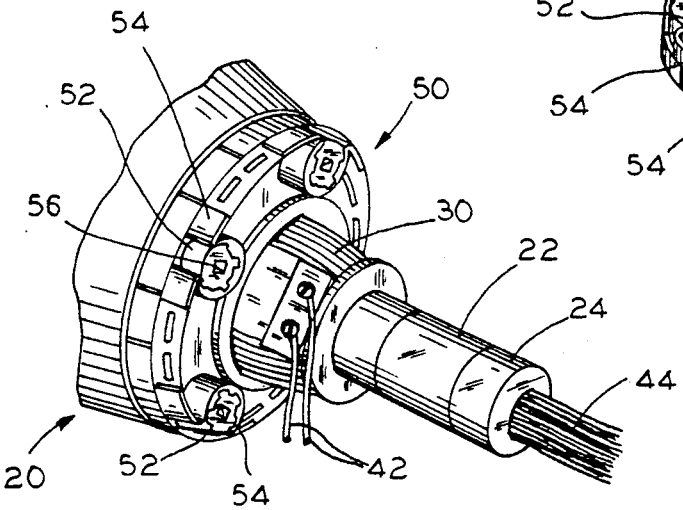
FIG. 6 is a perspective view of the yoke of FIG. 5 in place on the neck of a cathode ray tube.

Each cylindrical magnet has a square, hexagonal or otherwise keyed member, such as a hole, 56, formed therein. The trim magnets are adjusted by joining a suitable tool with the keyed member or holes 36 and rotating them. In FIG. 6, yoke 50 is in place on the neck 22 of the cathode ray tube 20. The trim magnets 52 may be adjusted at this time by use of a tool similar to a long screw driver having a bit which fits into hole 56. Other suitably keyed rotating means may be provided. For example, the magnets could be mounted on a gear that is rotated by a pinion gear.

Figure 7:
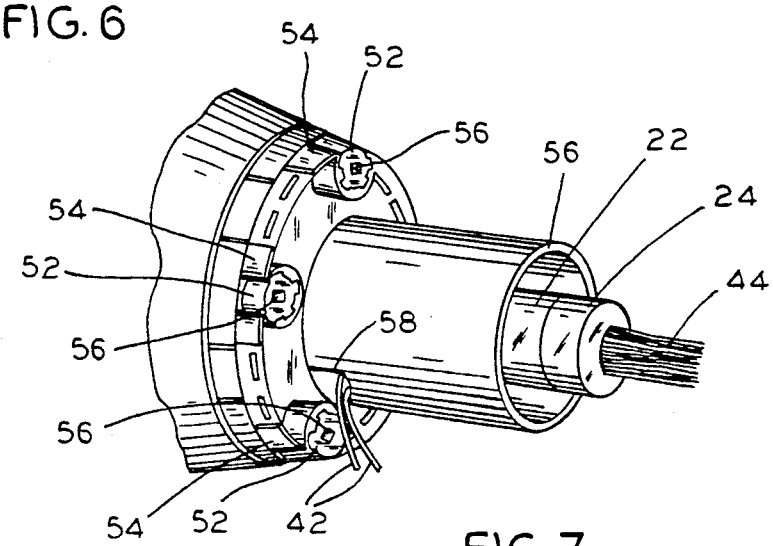
FIG. 7 is a perspective view of the yoke and cathode ray tube with the inventive magnetic shield in place over the yoke of FIG. 6.

In FIG. 7, an inventive shield 56 is in place over the yoke 50 of FIG. 6. The deflection coil wires 42 pass through notch 58. In this embodiment, the trim magnets 52 are outside the shield 56; therefore, it is not necessary to remove the shield in order to adjust them. It is only necessary to place the tool in the keyed holes 56 and to rotate the cylindrical or barrel-shaped magnets 52. Since the magnet-adjusting tool may be long, it is possible to rotate and thereby adjust the magnets and the positions of their fields from a location outside a cabinet in which the cathode ray tube may be mounted.

The diameter of the shield of FIG. 7 is smaller than the diameter of the shield of FIG. 3, thus fitting directly over the yoke deflection coils. With this approach, the geometry trim magnets 52 remain outside the shield, which causes much less interaction between the shield and geometry magnets. Also, the smaller shield 50 provides a more effective shielding which occurs as a result of the tight coupling between the shield and the deflection coils. Of course, there is still some small degree of magnetic flux interaction between shield and geometry trim magnets. However, a compensation for that interaction is easily managed because there is a complete access to enable an adjustment of the barrel magnets by a tool extending through the rear opening 56 in the magnet body 52. It is also remarkable that the adjustment process in this method is exacting, since once the shield is installed, and it remains fixed.

In a preferred embodiment, shield 56 has an inside radius of 1.75 inches. In general, the longer the shield, the better; however, the final and practical length is adequate to cover the deflection coils. Approximately a two-inch length is usually enough. In any event, the length and diameter of any given shield is usually empirically determined.

The shields 46 and 56 are made of Mu-metal about 0.006" (0.154 mm) thick. Mu-metal is a nickel-iron alloy having a high magnetic permeability, which is available in either strip or sheet form. Mu-metal is described in military specification MIL-N-14411C (MR), copy available from Director, Army Material & Mechannics, Research Center, Attn: AMXMR-LS, Watertown, MA 02172.

The chemical composition of Mu-metal is described in Table I:

TABLE I

| Composition | Carbon max | Manganese max | Silicon max | Phosphorous max | Sulfur max | Chromium max | Nickel | Molybdenum | Copper | Iron |
|---|---|---|---|---|---|---|---|---|---|---|
| | Chemical composition, percent | | | | | | | | | |
| 1 | 0.03 | 0.95 | 0.42 | 0.02 | 0.008 | — | 79.0–80.6 | 3.8–5.0 | — | Rem |
| 2 | 0.05 | 1.8 | 0.50 | 0.02 | 0.02 | 3.0 | 75.0–77.0 | — | 4.0–6.0 | Rem |
| 3[1] | 0.035 | 0.8 | 0.50 | 0.02 | 0.008 | — | 47.0–50.0 | — | — | Rem |
| 4[2] | 0.035 | 0.8 | 0.50 | 0.02 | 0.008 | — | 47.0–50.0 | — | — | Rem |
| 5 | 0.02 | 0.7 | 0.15 | 0.02 | 0.008 | — | 79.0–80.6 | — | — | Rem |

[1]Available in all forms. Random - oriented magnetic properties.
[2]Available as strip 0.020 inch or less thickness; semi-oriented magnetic properties.

The DC magnetic properties of Mu-metal are described in Table II:

TABLE II

| Composition | Form | DC MAGNETIC PROPERTIES Permeability, μ, minimum B-100 Gausses | B-2500 Gausses | B-5000 Gausses | μ, maximum | Coercive force Max $H_C$ (oersteds) |
|---|---|---|---|---|---|---|
| 1 | All | 40,000 | 160,000 | — | 200,000 | 0.02 from B = 6800 Gausses |
| 2 | All | 15,000 | 52,000 | — | — | — |
| 3 | Sheet[1] Strip[1] Bar Rod Wire | 7,000 | — | 60,000 | 60,000 | 0.07 from B = 10,000 Gausses |
| 4 | Strip[2] All[2] | — | — | — | — | — |

[1]0.026 inch thickness and over.
[2]Magnetic properties of compositions 4 and 5 to be agreed upon by the manufacturer and purchaser (see 6.2).

The AC magnetic properties of Mu-metal are described in Table III:

TABLE III

| Composition | Thickness (inch) | AC (60 CPS) MAGNETIC PROPERTIES[1], SHEET-STRIP[2] Permeability, minimum value B-40 Gausses | B-200 Gausses | B-2,000 Gausses | B-4,000 Gausses | B-8,000 Gausses |
|---|---|---|---|---|---|---|
| 1 | 0.025 | 35,000 | 39,000 | 48,000 | — | — |
| | 0.014 | 55,000 | 60,000 | 80,000 | | |
| | 0.006 | 60,000 | 80,000 | 140,000 | | |
| | 0.002 | 60,000 | 80,000 | 150,000 | | |
| 2 | — | — | — | — | — | — |
| 3 | 0.020 | 5,700 | 9,000 | 21,000 | 28,000 | — |
| | 0.014 | 7,500 | 13,500 | 28,000 | 40,000 | 45,000 |
| | 0.006 | 8,000 | 14,500 | 38,000 | 52,000 | 65,000 |
| 4 | 0.020 | 9,500 | 13,000 | 26,000 | 30,000 | — |
| | 0.014 | 10,000 | 14,500 | 32,000 | 40,000 | 45,000 |
| | 0.006 | 11,000 | 17,000 | 46,000 | 56,000 | 62,000 |
| 5 | 0.001/0.010 | — | — | — | — | — |

[1]For intermediate thicknesses not shown, minimum permeabilities can be determined by plotting thickness versus minimum values given and obtain minimum value for a given thickness.
[2]0.025-inch thickness and less.

Although the shield has been described as a cylindrical tube, it should be apparent that tubes may also have other cross sections, especially when unique problems are encountered.

Those who are skilled in the art will readily perceive various improvements and modifications; therefore, the appended claims are to be construed to cover all equivalents falling within the spirit and scope of the appended claims:

I claim:

1. An electromagnetic field control device for cathode ray tubes, said device comprising yoke means having at least a deflection coil, means for positioning said yoke means on a cathode ray tube envelope at a position determined by an effect of said deflection coil upon an electron beam within said cathode ray tube, a plurality of permanent magnets adjustably mounted on said yoke to cooperate with said effect produced upon said electron beam by said deflection coil, said permanent magnets having a keying means for enabling a manual movement of said magnets in order to adjust a display on said cathode ray tube, and removable magnetic shield means surrounding said deflection coil for reducing stray electromagnetic fields extending from said coil outwardly and beyond said shield without adversely affecting said electromagnetic field acting inwardly through said envelope forming said cathode ray tube and upon said electron beam, said keying means being accessible to enable said movement of said magnet while said shield remains in place surrounding said deflection coil.

2. The device of claim 1 wherein each of said plurality of permanent magnets is a shape which may rotate about an axis of rotation, and means for rotatably mounting said magnets on said yokes.

3. The device of claim 2, where the shape of said permanent magnet is cylindrical.

4. The device of claim 2 wherein each of said shaped permanent magnets has said keying means associated therewith for enabling a suitable tool to rotate the permanent magnet.

5. The device of claim 2 wherein said yoke has a plurality of clips adjacent a periphery thereof, each of said shaped magnets being rotatably supported in an individually associated one of said clips.

6. The device of any one of the claims 2-5, wherein said shield means is a tubular member made of Mu-metal which fits over at least said deflection coil and which is long enough to suppress said outwardly radiated electromagnetic field.

7. An electromagnetic field control device for cathode ray tubes, said device comprising yoke means having at least a deflection coil, means for positioning said yoke means on a cathode ray tube envelope at a position determined by an effect of said deflection coil upon an electron beam within said cathode ray tube, a plurality of permanent magnets adjustably mounted on said yoke to cooperate with said effect produced upon said electron beam by said deflection coil, said yoke means including a plurality of spoke-like posts radiating from said yoke, each of said permanent magnets being mounted to rotate about an individually associated one of said posts in order to make a geometric adjustment of said electron beam, and removable magnetic shield means surrounding said deflection coil for reducing stray electromagnetic fields extending from said coil outwardly and beyond said shield without adversely affecting said electromagnetic field acting inwardly through said envelope forming said cathode ray tube and upon said electron beam.

8. The device of claim 7 wherein each of said permanent magnets is a square plate having a mounting means in the middle of the square for movably engaging an individually associated one of said posts.

9. The device of any one of the claims 7 or 8, wherein said shield means is a tubular member made of Mu-metal which fits over at least said deflection coil and which is long enough to suppress said outwardly radiated electromagnetic field.

10. The device of claim 8, wherein said tubular shield member surrounds both said permanent magnets and said deflection coil.

11. The device of claim 8 wherein said tubular shield member surrounds said coil with said permanent magnets outside of said tubular member.

12. The device of claim 8, wherein said tubular shield member has a notch in one end for enabling wires to pass between said shield and a bell on the envelope of said cathode ray tube.

13. The device of claim 8, wherein said tubular shield member surrounds both said deflection coil and said permanent magnets.

14. An electromagnetic shielding device for a video display monitor, said monitor including a cathode ray tube mounted within a restricted area which makes it difficult to work on or near said tube and within said area, a yoke having a deflection coil and at least one trim magnet mounted on a neck of said tube, a shield made of magnetic material slidably positioned over and surrounding at least said deflection coil for suppressing at least some electromagnetic effects generated by said deflection coil in order to reduce an electromagnetic field in the vicinity of said monitor, keying means for adjusting said trim magnet without necessarily having to remove said shield, said keyed means being a hole formed in an end of the magnet, said trim magnet being a magnet which is mounted for axial rotation, and means associated with said magnet for rotating it in response to a manipulation of a tool which may reach said hole formed in said magnet from outside said area and into said restricted area.

15. The device of claim 14, wherein said shield is a cylinder having a radius which enables it to fit over and contain said deflection coils while said magnets remain outside said shield and exposed to be positionally adjusted without necessarily having to remove said shield.

16. The device of claim 15 where said shield is made of Mu-metal.

* * * * *